US005431071A

United States Patent [19]

Williams

[11] Patent Number: 5,431,071

[45] Date of Patent: Jul. 11, 1995

[54] KNIFE BLADES

[75] Inventor: David M. Williams, Sheffield, United Kingdom

[73] Assignee: McPherson's Limited, Melbourne, Australia

[21] Appl. No.: 117,105

[22] PCT Filed: Apr. 24, 1992

[86] PCT No.: PCT/GB92/00756

§ 371 Date: Dec. 8, 1993

§ 102(e) Date: Dec. 8, 1993

[87] PCT Pub. No.: WO92/19424

PCT Pub. Date: Nov. 12, 1992

[30] Foreign Application Priority Data

Apr. 24, 1991 [GB] United Kingdom ..... 9108759

[51] Int. Cl.[6] ..... B26B 9/00

[52] U.S. Cl. ..... 76/104.1; 30/350

[58] Field of Search ..... 76/101.1, 104.1, DIG. 8, 76/DIG. 9; 30/346.54, 350, 357; 83/697

[56] References Cited

U.S. PATENT DOCUMENTS 4,653,373 3/1987 Gerber ..... 30/350

*Primary Examiner*—Douglas D. Watts

*Attorney, Agent, or Firm*—Trexler, Bushnell, Giangiorgi & Blackstone, Ltd.

[57] ABSTRACT

The invention relates to knife blades and in particular to a method of their production, and has for its object the provision of a knife blade with a cutting edge formed by a surface harder than the material of the body of the blade. This objective is met by a method comprising grinding a first face (2) of a V-shaped cutting edge to one side of the blank (1) to locate the lower edge of the first side face (2) at the approximate mid-point across the thickness of the blank (1), providing on the partly-ground blank (1) a hard surface (3) around the periphery of the blank (1) at least over the height of the first ground face (2) and grinding a second face (4) of the V-shaped cutting edge to the opposite side of the blank (1), to locate the V-shaped cutting edge at the approximate mid-point across the thickness of the blank (1).

18 Claims, 1 Drawing Sheet

KNIFE BLADES

Figure 1:
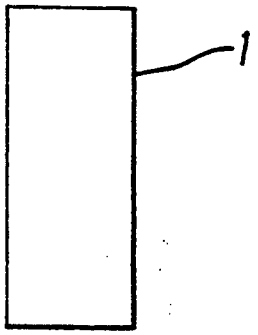
Figure 2:
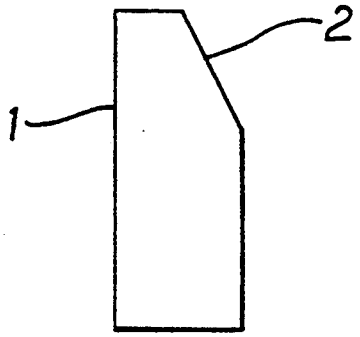
Figure 3:
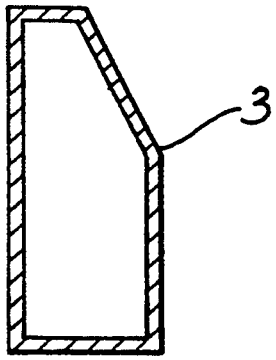
Figure 4:
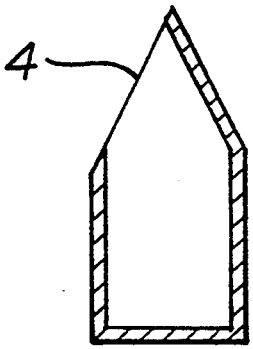

This invention relates to knife blades and is particularly concerned with a method of producing knife blades.

It has long been known that the surface hardness and wear resistant properties of metal objects can be enhanced by the provision of a hard surface on the metal objects. Thus it is known to generate a carbide and/or nitride enriched or transformed surface, by an appropriate heat treatment, and also known to provide a hard surface coating such as by carburising or nitriding, chemical or physical vapour deposition, electroplating, plasma arc spraying, and other equivalent processes.

When considering a knife blade, providing a hard surface particularly at the cutting edge, it is difficult to put into practice by either of the general techniques outlined above, as a consequence of the very thin sections of blank ordinarily employed in knife blade construction, and the acute angle to be found at the cutting tip. To take a finished blade and subject it to a heat treatment to provide an enriched or transformed hard surface layer, there is the inevitable depletion of carbon from the body of the blade, leaving a blade of insufficient strength, and with surface coatings there is an inevitable build-up of coated material at the cutting edge which has a major adverse effect on the sharpness of the blade.

Attempts have been made hitherto to apply a hardened surface to a knife blade such as by a diffusion heat treatment and by vapour deposition of carbides or nitrides. Here the situation has been the treatment of a tapered blank followed by a single whetting or grinding to form a chisel cutting edge and to put the cutting edge in line with one side face of the blank. When subjected to recognised edge testing procedures, such knives demonstrated no significant improvement in either their original sharpness or in edge retension in comparison with untreated blades of the same configuration.

The object of the present invention is to provide a knife blade with a cutting edge of a harder material than the body of the blade, and a method of producing knife blades with such harder edge, and which display a major improvement in cutting performance in comparison with conventional blades.

According to the present invention, a method of producing a knife blade comprising grinding a first face of a V-shaped cutting edge to locate the lower edge of the first side face at the approximate mid-point across the thickness of the blank, and grinding a second side face of the V-shaped cutting edge to the opposite side of the blank to locate the V-shaped cutting edge at the approximate mid-point across the thickness of the blank, characterised in that following the grinding of the first side face a hard surface is formed on the periphery of the blank over at least the height of the first ground face and after the formation of the hard surface, the second face of the V-shaped cutting edge is ground.

Whilst the whole of the partly ground blank may be provided with a hard surface, it is preferable to shield the blank to limit the application of the hard surface to the cutting edge.

As a consequence of the part-grinding of the blank for the knife, a considerably greater width of the hard enriched, transformed or coated surface of the blade at the intended location of the cutting edge is provided, in comparison with the treating of a finished blade. Thus when it is the case of forming the hard surface by a heat treatment process, the weakening of the body of the blade is reduced, and when the second face is subsequently ground to complete the V-shaped cutting edge some at least of the depleted zone of the body is removed. However, the principal advantage of the invention is that at the actual cutting tip the whole of the cutting edge itself is formed by the hard enriched, transformed or coated surface, and vertically behind which is the body part of the blade providing support for the hard surface at the tip. Equally, and when it is the case of providing a surface coating, the application of the coating to a partly-ground blank is such that there is inevitable rounding of the surface coating material at the junction between the first ground face on the blank and the unground section of the edge of the blank immediately adjacent to the edge of the ground face. Thus, and following coating, the grinding of the second face of the V-shaped cutting edge again leaves the actual tip of the cutting edge formed totally from the coating or transformed material, the grinding of the second face at the same time providing a cutting edge on the material forming the cutting edge, and in an essentially similar manner as is mentioned above with enriched surfaces, the body material of the blank lies vertically behind the vertical edge formed from the cutting surface of the material.

When treating a blank, considerably care must be exercised to avoid negating the temper of the body material of the blank. Thus, in applying the hard material to the blank, the temperature of the blank should be kept below 200° C.

Preferably, the material of the blank is a martensitic stainless steel having a carbon content in the range 0.16% to 0.36%, and further preferably has a chromium content of 12% to 14%. Whilst the surface finish of the blank is not critical, it is highly desirable that it is not highly polished and not overly rough. It is therefore preferred that the surface finish on the blank is in the range 0.1RA to 2.0RA. Desirably the hardness of the blank is in the range 46–54 HRC.

For optimum performance characteristics, the depth of an enriched or transformed surface at the cutting edge or the thickness of an applied hard surface coating should be in the range 2.0 μm to 13 μm, and preferably in the range 3μm to 7 μm.

Whilst of necessity the cutting edge formed on the blank must be a discrete vee cutting edge with the cutting tip lying substantially central of the blank width, the blank can be a parallel sided blank or can of itself by tapered to one or to both sides.

The cutting edge itself can be formed by flat grinding or plunge grinding a first face prior to the effecting of the surface treatment or coating and flat or plunge grinding the second face subsequent to the treatment or coating stage. However, other edge forms can be provided with enhanced performance within the present invention. Thus, the two grinding stages can be such as to provide a hollow ground edge. Equally the edge from can be the first grinding of a face of the vee shape cutting edge with serrations scallops or combinations thereof and the flat or plunge grinding of the second face.

Particularly with a plunge or flat ground edge form, it is preferred that the vee shape cutting edge has an included angle of 14° to 30°. Further preferably the included angle lies between 16° and 22° and still further preferably the included angle lies between 18° and 20°.

In the form of construction where a first face of the vee shape cutting edge is ground with serrations, it is preferred to provide between 1.02 and 0.5 serrations per mm and further preferably to provide 0.64 serrations per mm. Desirably the included angle of the serrations lies between 80° and 100°, preferably 90°. In the form of construction where a first face of the vee-shape cutting edge is ground with scallops, the scallops may have a radius in the range 0.254 mm to 31.75 mm preferably 4.064 mm to 19.05 mm and may have a pitch in the range 25.4 mm to 2.54 mm and preferably 25.4 mm to 5.08 mm.

An essential advantage of the invention in addition to the provision of considerably enhanced performance characteristics in comparison with conventional blades lies in the fact that no subsequent process beyond the second grinding stage is required save perhaps for a final polishing.

Figure 5:
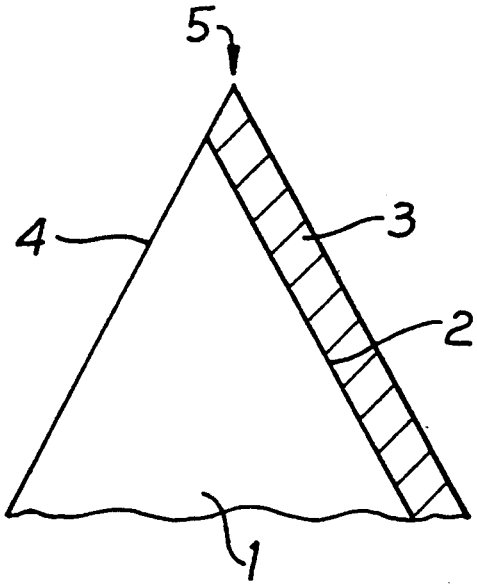

One embodiment of the invention will now be described by way of example only with reference to the accompanying drawings in which FIGS. 1 to 4 show schematically the sequence of the method of the invention; and FIG. 5 is a view to a greatly enlarged scale of the cutting edge of a blade when formed from the method of the invention.

Thus, as is illustrated in FIGS. 1 to 4, a blank 1 for a knife blade is first ground with the first face 2 of a V-shaped cutting edge. The blank in partly-ground form is then subjected to the provision of a hard surface 3 by an appropriate heat treatment or coating process, and the blank with its hard surface then subjected to a further grinding to provide the second face 4 of the V-shaped cutting edge.

As is illustrated in FIG. 5, the result of the method of the invention is to produce an actual cutting tip 5 formed wholly from the material of the enriched, transformed, or coated surface, and lying vertically behind the cutting tip is the body material of the blank. Thus, and given that certain of the possible surface enrichment, transformation or coating treatments can generate an exceedingly hard but brittle structure, the cutting tip lying vertically below the body material of the blank lends considerable support to the cutting tip to guard against it shearing or otherwise being damaged during normal use of the blade.

Another perceived advantage is that the grinding of the second face 4 subsequent to treatment and hence leaving the second face 4 devoid of a hard surface has the result that during normal use wear can take place of the exposed surface 4 to provide a somewhat hollow ground effect immediately behind the cutting edge and which has a noticeable effect other maintenance of the sharpness of the cutting edge.

To illustrate the effectiveness of blades when formed in accordance with the invention, comparative testing of two control blades and four blades formed in accordance with the invention has been effected. The first control blade was formed from a parallel blank with a v-shaped cutting edge with the cutting tip located substantially centrally of the blank width, with the v-shaped cutting edge plain to both sides and the edge untreated. The second control blade was formed in accordance with British Patent No. 0220362 i.e., a parallel blank with a centrally formed v-shaped cutting edge plain ground to one side and ground with cutting formations to the other. The blades in accordance with the invention were a plain edged blade as defined above but with a diffused surface formed from vanadium carbide to one side of the vee, and four blades formed in accordance with the second control blade but with a vanadium carbide coating formed by physical vapour deposition over the side of the v-shaped cutting edge bearing the cutting formulations.

The test was conducted by providing a stack of 150 pieces of card in a holder and the holder loaded into a mechanical slide and placed on a blade fixed in position with its cutting edge uppermost, the total static weight of the card stack, the holder and the slide amounting to 30N, the card stack being reciprocated at a constant rate of 50 mm/sec. The number of strokes taken to cut through a stack of cards was noted and the stack replaced when cut completely through, the test being treated as ended when more than 150 strokes were required to cut through a stack of cards. The results of the above tests were as follows:

| | |
|---|---|
| Plain Edge Control | 750 cards cut |
| Serrated Edge Control | 28800 cards cut |
| Plain Edge Diffused VC | 34400 cards cut |
| Serrated Edge Diffused VC | 45900 cards cut |
| Serrated Edge P.D.V. VC | 47400 cards cut |

As will be perceived from the above and a comparison of a plain edged control blade and a plain edged blade formed in accordance with the invention, a major improvement in cutting performance is provided. Even with the serrated edge control blade, itself widely recognised as providing a significant improvement in cutting performance over its predecessors, a most significant further improvement is provided when formed in accordance with the present invention.

I claim:

1. A method of producing a knife blade comprising grinding a first face (2) of a V-shaped cutting edge to locate the lower edge of the first side face (2) at the approximate mid-point across the thickness of the blank (1), and grinding a second side face (4) of the V-shaped cutting edge to the opposite side of the blank (1) to locate the V-shaped cutting edge at the approximate mid-point across the thickness of the blank (1), characterised by following the grinding of the first side face (2), forming a hard surface (3) on the periphery of the blank (1) over at least the height of the first ground face (2) and after the formation of the hard surface (3), grinding the second face (4) of the V-shaped cutting edge and shielding the partly-ground blank (1) to limit the application of the hard surface to the ground face (2) and the remaining surface of the edge face of the blank (1) adjacent the intended position of the cutting edge.

2. A method of producing a knife blade as in claim 1, characterised in that the whole of the partly-ground blank (1) is provided with a hard surface (3).

3. A method as in claim 1, characterised in that the partly-ground blank (1) is shielded whereby to limit the application of the hard surface to the ground face (2) and the remaining surface of the edge face of the blank (1) adjacent the intended position of the cutting edge.

4. A method as in claim 1 characterised by forming the hard surface by a heat treatment process.

5. A method as in claim 1 characterised by forming the hard surface by the enrichment or transformation of at least the ground face (2) of the blank (1).

6. A method as in claim 1 characterised by forming the hard surface by a surface coating provided on at least the ground face (2) of the blank (1).

7. A method as in claim 1 characterised in that during surface treatment maintaining below 200° C., the temperature of the blank.

8. A method of producing a knife blade comprising grinding a first face (2) of a V-shaped cutting edge to locate the lower edge of the first side face (2) at the approximate mid-point across the thickness of the blank (1), and grinding a second side face (4) of the V-shaped cutting edge to the opposite side of the blank (1) to locate the V-shaped cutting edge at the approximate mid-point across the thickness of the blank (1), characterised by following the grinding of the first side face (2), forming a hard surface (3) on the periphery of the blank (1) over at least the height of the first ground face (2) and after the formation of the hard surface (3), and grinding the second face (4) of the V-shaped cutting edge wherein the material of the blank (1) is a martensitic stainless steel having a carbon content in the range 0.16% and a chromium content of 12% to 14%.

9. A method as in claim 8 characterised in that the surface finish on the blank is in the range 0.1RA to 2.0RA.

10. A method as in claim 8 characterised in that the hardness of the blank (1) is an the range 46–54 HRC.

11. A method of producing a knife blade comprising grinding a first face (2) of a V-shaped cutting edge to locate the lower edge of the first side face (2) at the approximate mid-point across the thickness of the blank (1), and grinding a second side face (4) of the V-shaped cutting edge to the opposite side of the blank (1) to locate the V-shaped cutting edge at the approximate mid-point across the thickness of the blank (1), characterised by following the grinding of the first side face (2), forming a hard surface (3) on the periphery of the blank (1) over at least the height of the first ground face (2) and after the formation of the hard surface (3), and grinding the second face (4) of the V-shaped cutting edge, wherein depth or thickness of said hard surface is in the range 2.0 μm to 12.0 μm.

12. A method as in claim 11, characterised in that said depth or thickness in the range 3.0 μm to 7.0 μm.

13. A method as in claim 8 characterised in that the centrally located V-shaped cutting edge is formed on a blank having parallel side faces.

14. A method as in claim 8 characterised in that the centrally located V-shaped cutting edge is formed on a blank having tapered side faces.

15. A method as in claim 8 characterised in that the side faces (2, 4) are formed by flat or plunge grinding.

16. A method as in claim 8 characterised in that one side face (2 or 4) may be formed with cutting formations.

17. A method as in claim 8 characterised in that one or both ground faces (2, 4) are hollow ground.

18. A method as in claim 15, characterised in that the V-shaped cutting edge has an included angle between 14° and 30°.

* * * * *

UNITED STATES PATENT AND TRADEMARK OFFICE

CERTIFICATE OF CORRECTION

PATENT NO. : 5,431,071

DATED : July 11, 1995

INVENTOR(S) : David M. Williams

It is certified that error appears in the above-indentified patent and that said Letters Patent is hereby corrected as shown below:

Column 5, Line 22 "0.16%" should read — 0.16% to 0.36% —

Signed and Sealed this

Twenty-third Day of April, 1996

Bruce Lehman

*Attest:*

BRUCE LEHMAN

*Attesting Officer*

*Commissioner of Patents and Trademarks*